US005341631A

United States Patent [19]

Boesman et al.

[11] Patent Number: 5,341,631

[45] Date of Patent: Aug. 30, 1994

[54] DOUBLE-TWISTING DEVICE WITH MAGNETIC DEVICE FOR ELEVATING AXIAL FORCES

[75] Inventors: Peter Boesman, U. La Vina, Venezuela; Marc Derdeyn, Zwevegem, Belgium

[73] Assignee: N. V. Bekaert S.A., Zwevegem, Belgium

[21] Appl. No.: 892,319

[22] Filed: Jun. 2, 1992

[30] Foreign Application Priority Data

Jul. 4, 1991 [EP] European Pat. Off. ..... 91201727.4

[51] Int. Cl.[5] ..... D01H 1/10; D01H 7/86

[52] U.S. Cl. ..... 57/58.83; 57/58.38

[58] Field of Search ..... 384/446; 57/58.36, 58.38, 57/58.83, 352, 58.76, 264

[56] References Cited

U.S. PATENT DOCUMENTS 4,371,218 2/1983 Ichikawa ..... 308/10
4,773,210 9/1988 Landwehrkamp et al. .... 384/446 X
4,785,617 11/1988 Bourgois et al. ..... 57/58.52
4,872,769 10/1989 Krause et al. ..... 384/446 X
5,118,278 6/1992 Nishijima et al. ..... 57/58.52 X

FOREIGN PATENT DOCUMENTS 0231807 8/1987 European Pat. Off. .
2632976 1/1978 Fed. Rep. of Germany .
2634070 2/1978 Fed. Rep. of Germany .
270821 11/1987 Japan ..... 384/446
69817 3/1989 Japan ..... 384/446

*Primary Examiner*—Daniel P. Stodola
*Assistant Examiner*—William Stryjewski
*Attorney, Agent, or Firm*—Foley & Lardner

[57] ABSTRACT

A double-twisting device (2) includes two half-shafts (4) and at least one flyer (6). The flyer (6) connects the two half-shafts (4) and causes axial forces $F_a$ which are exerted upon the half shafts (4) during rotation. The double-twisting device (2) further includes a magnetic device (22, 24) which are suited to compensate at least partially for the axial forces $F_a$. This increases the life span of the bearings (8) and considerably reduces the maintenance costs of the double-twisting device.

8 Claims, 2 Drawing Sheets

DOUBLE-TWISTING DEVICE WITH MAGNETIC DEVICE FOR ELEVATING AXIAL FORCES

BACKGROUND OF THE INVENTION

1. Field of the Invention

The present invention relates to a double-twisting device comprising two half-shafts and at least one flyer. The flyer or the flyers connect the two half-shafts.

2. DESCRIPTION OF THE RELATED ART

It is possible that the embodiment of the double-twisting device is as follows: a disc is fixedly mounted at an extremity of each half-shaft and the flyer(s) is (are) connected to the discs. In such an embodiment the flyer or the flyers still "connect" the two half-shafts in the sense of the present invention. In other words, the fixedly connected discs are considered as being parts of the half-shafts.

Such double-twisting devices are widely used for manufacturing steel cords for reinforcement of elastomer or other metal cables. They are called double-twisting devices since for every rotation of the rotor, two twists are given to the cord or cable. Double-twisting devices are called bunchers in some publications.

Drawbacks of the known double-twisting devices are the short life span of the bearings and the maintenance problems associated with and costs of these bearings.

SUMMARY OF THE INVENTION

It is an object of the present invention to increase the durability of the bearings of a double-twister.

It is a further object of the present invention to decrease the maintenance costs of the bearings of a double-twister.

According to the present invention, there is provided a double-twisting device which comprises two half-shafts and at least one flyer. The flyer(s) connect the two half-shafts and cause axial forces during rotation. The axial forces are exerted on the half-shafts. The double twisting device further comprises magnetic means suitable to compensate at least partially for the axial forces produced during rotation.

The inventors have discovered that the flyer, which functions as a guiding bow for the steel or metal elements, causes great axial forces upon the two half-shafts, and as a consequence, upon the bearings of the two half-shafts. The axial forces are a direct consequence of the centrifugal forces on the flyers during operation of the double twisting device. The centrifugal forces are high because of the following reasons:

(1) a high rotation speed of the flyer;

(2) the fact that metal or steel elements are twisted; these elements are heavy and therefore require a flyer which is rigid enough to guide these elements, and as a consequence, the unit "flyer-metal element" is rather heavy.

High centrifugal forces cause high axial forces. These high axial forces which may be up to 15000N (Newton) or more, decrease considerably the durability of the bearings, cause a lot of maintenance problems, and increase the costs of the double twisting device.

A number of alternative solutions may be used to solve the problem of the axial forces. All of these alternative solutions, however, have their own drawbacks.

A first alternative is to use bearings which are suited to receive both radial and axial forces. Such bearings, which are well known in the art, require a lot of time for their mounting. Irregularities in the mounting can considerably decrease the durability of the bearings.

A second alternative is to use double-twisting devices without flyers. In these flyerless devices, however, accurate and complicated tension control of the cable, or cord elements is required during manufacturing.

Coming back to the invention, the greatest axial forces are obtained during the maximum rotation velocity of the double-twister. The magnetic means according to the invention may wholly or partially compensate for these greatest axial forces. The part of the axial forces which is not compensated for may be received by means of a suitable bearing configuration.

Preferably, the magnetic means comprise a magnet and a disc. Preferably, the magnet is an electromagnet. Conveniently, the disc may be fixedly mounted on the half-shaft. As a consequence, the disc rotates at the same velocity of the half-shafts.

The magnet may or may not be rotatably mounted with respect to the half-shafts.

In a first embodiment the magnet does not rotate. In a second embodiment the magnet rotates but with a velocity different from the velocity of the half-shafts. In a third embodiment the magnet rotates with the same velocity of the half-shaft.

The magnetic means may be mounted on the half-shafts between the bearings and the flyer(s). In another embodiment the magnetic means are mounted on the half-shafts at the axially outer sides of the bearings.

In a particular embodiment, the magnetic means are suitable to create an axial force during standstills, this axial force having the same sense as the axial force caused by the flyer(s) during rotation. This produces an advantage in that if bearings which receive axial forces in one sense are used, such bearings need no longer be accompanied by another bearing which is suited to receive axial forces in the other sense. As will be explained hereinafter, this particular embodiment enables a lot of flexibility in the choice of a proper bearing configuration.

BRIEF DESCRIPTION OF THE DRAWINGS

The invention will now be explained with reference to the accompanying drawings wherein.

DESCRIPTION OF THE PREFERRED EMBODIMENT

Figure 1:
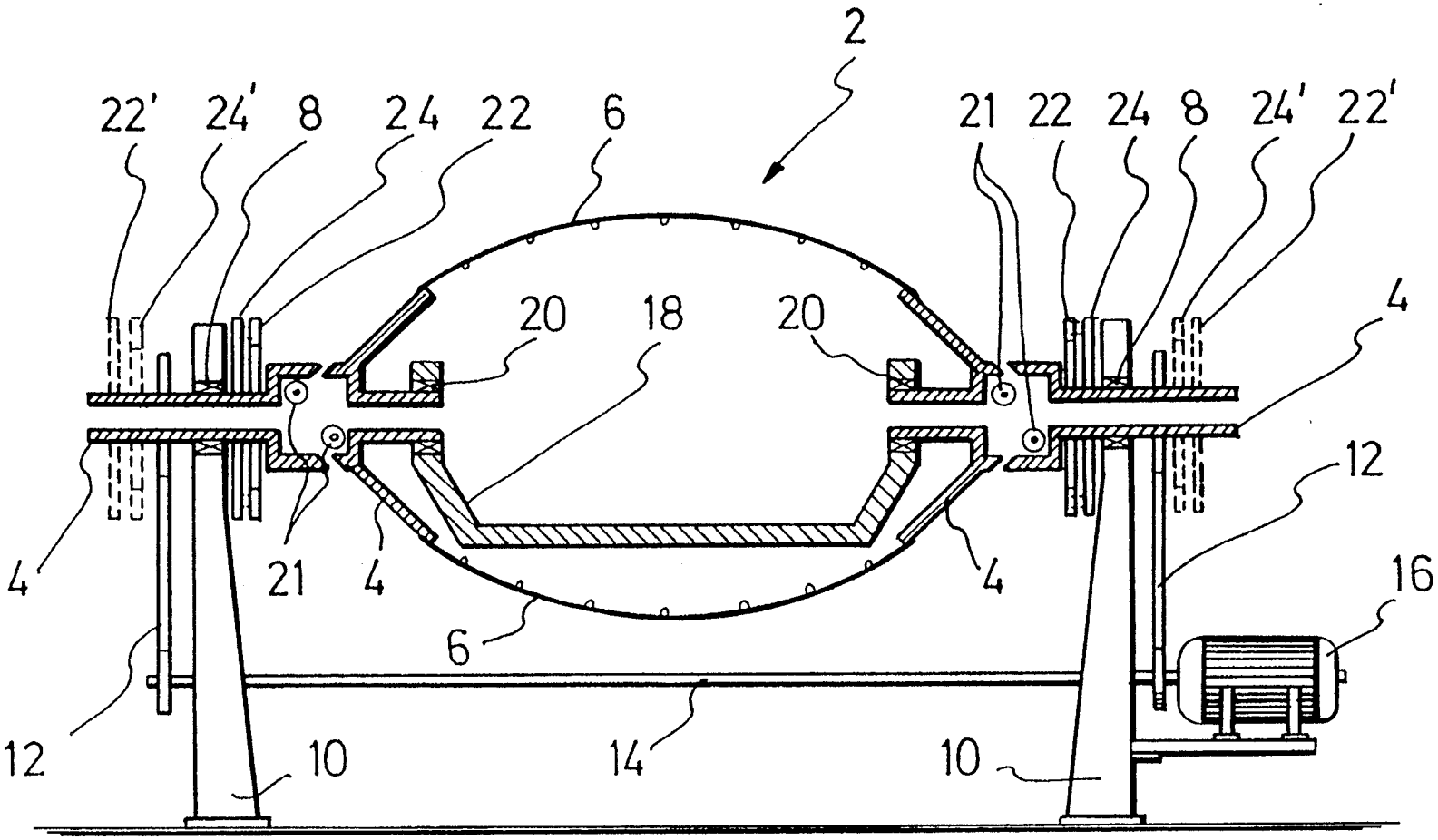
FIG. 1 shows an assembly view of a double-twisting device according to the invention.

Referring to FIG. 1, a double-twisting device 2 comprises two half-shafts 4 which are connected by means of two flyers 6 which function as guiding bows for the strand, cable, cord or their composing filaments or wires. The two half-shafts 4 are supported by means of bearings 8 in a housing 10. The two half-shafts 4 are synchronously driven by drive means 12-14-16, the drive means comprising an electric motor 16. A cradle 18 is mounted in a stationary position by means of bearings 20 within the rotor of the double-twisting device. Depending upon the kind of strand, cable or cord which is to be manufactured one or more guiding or reversing pulleys 21 which are mounted in the hollow half-shafts 4 are used.

Figure 2:
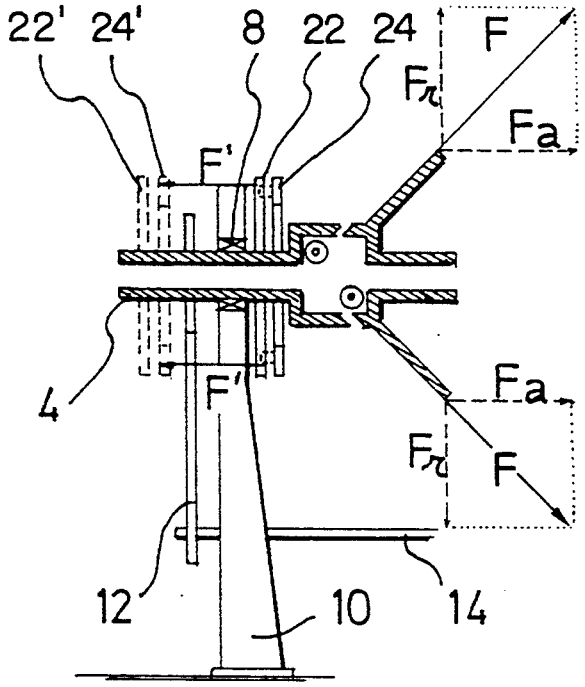
FIG. 2 shows the working of magnetic means in a double-twisting device.

Reference is now made to FIG. 2. During rotation the presence of the flyers 6 causes axial forces $F_a$ which are exerted upon the hollow shafts 4. These axial forces $F_a$ are compensated at least partially by means of a magnet 22 and a disc 24. The disc 24 is fixedly mounted on the hollow half-shaft 4. Due to the action of the magnetic field an axial force F' is exerted upon the disc 24.

It is hereby explicitly understood that the magnet 22 must be constructed in a way to create axial forces, in contradistinction to magnets which must create rotationary moments such as magnetic brakes. Magnets which create axial forces are known as such in the art.

In operation, i.e. during rotation, the inventors have observed that the warming up of the disc 24 is very limited. This means that the presence of the magnetic means (22–24) does not impose restrictions to the maximum rotational velocity of the rotor of the double-twisting device 2.

In FIGS. 1 and 2 two possible configurations are illustrated: in a first configuration the magnetic means 22–24 are mounted between the flyers 6 and the bearings 8, while in a second configuration (dotted lines) the magnetic means 22'–24' are mounted at the axially outer sides of the bearings 8.

Figure 3:
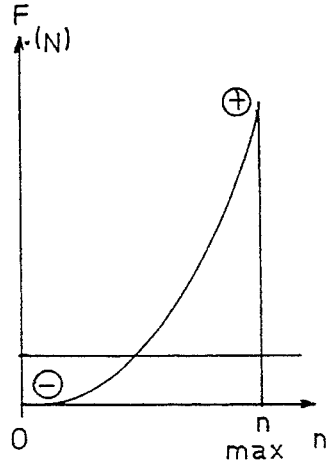
FIG. 3 shows a force versus rotation velocity diagram of a magnet to be used in a particular embodiment of the invention.

In a particular embodiment, the magnet 22 is so designed that during standstill of the double-twisting device 2 it creates an axial force which has sense of direction than the sense of direction of the axial force created during rotation which compensates for the action of the flyers. A possible force versus rotational velocity diagram of the magnet is shown in FIG. 3.

Figure 4:
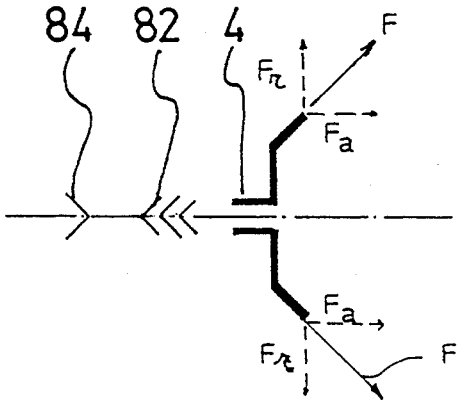
FIGS. 4(*a*) and 4(*b*) are schematic views of different bearing configurations to be used in a double-twisting device according to the invention.
Figure 4:
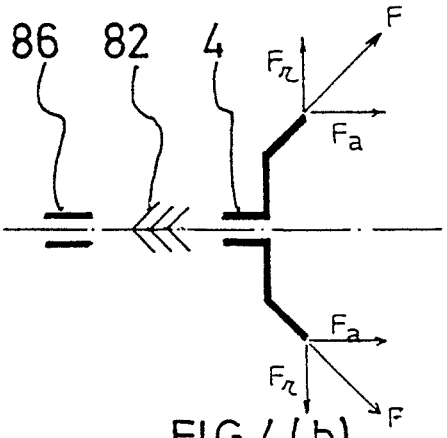

The advantage of this particular embodiment will be explained with reference to FIG. 4.

In cases where the magnet 22 does not always fully compensate for the axial forces $F_a$, bearings 82 which receive both axial and radial forces are still needed. Such bearings 82 which receive axial forces in one sense must always be combined with a bearing 84 (FIG. 4(*a*)) which is suited to receive axial forces in the other sense since during standstills the axial forces $F_a$ are no longer present. If a magnet with a force versus rotational velocity diagram as illustrated in FIG. 3 is used, then a bearing 84 which receives axial forces in the other sense is no longer necessary and bearings 86 (FIG. 4(*b*)) which receive only radial forces may be used. This may facilitate and simplify the mounting of the bearings. As a further consequence there is now a lot more flexibility in the choice of the configuration of the bearings.

We claim:

1. A double-twisting device comprising:

two rotatable half-shafts;

at least one flyer connecting the two half-shafts and being rotatable therewith, wherein during rotation of the two half shafts the at least one flyer causes axial forces to be exerted on the two half-shafts; and magnetic means, operatively connected to at least one of the two rotatable half-shafts, for at least partially compensating for the axial forces.

2. A double-twisting device according to claim 1, wherein the magnetic means comprise a magnet and a disc.

3. A double-twisting device according to claim 2, wherein the magnet is an electromagnet.

4. A double-twisting device according to claim 2, wherein the disc is fixedly mounted on at least one of the half-shafts.

5. A double-twisting device according to claim 2, wherein the magnet is rotatably mounted with respect to the half-shafts.

6. A double-twisting device according to claim 1, wherein the double-twisting device further comprises bearings which are mounted on the half-shafts and wherein the magnetic means are mounted between the bearings and the at least one flyer.

7. A double-twisting device according to claim 1, further comprising bearings mounted on the half-shafts and wherein the magnetic means are mounted on the half-shafts at axially outer sides of the bearings.

8. A double-twisting device comprising:

first and second rotatable half-shafts;

a flyer connecting said first half-shaft to said second half-shaft and being rotatable with said first and second half-shafts, the flyer causing first and second axial forces to be respectively exerted on said first and second half-shafts during rotating the first and second half-shafts;

first and second discs being respectively fixedly mounted on said first and second half-shafts; and first and second magnets respectively disposed proximate to said first and second discs, said first and second magnets respectively attracting said first and second discs and respectively causing third and forth axial forces to be respectively exerted on said first and second half-shafts, said third axial force approximately negating said first axial force and said fourth axial force approximately negating said second axial force.

* * * * *